US007226276B2

(12) United States Patent
Bez et al.

(10) Patent No.: US 7,226,276 B2
(45) Date of Patent: Jun. 5, 2007

(54) MULTI-STAGE RECIPROCATING VACUUM PUMP AND METHOD OF OPERATING THE SAME

(75) Inventors: Eckhard Bez, New Bern, NC (US); Stefan Zabeschek, Asslar (DE)

(73) Assignee: Pfeiffer Vacuum GmbH, Asslar (DE)

( * ) Notice: Subject to any disclaimer, the term of this patent is extended or adjusted under 35 U.S.C. 154(b) by 632 days.

(21) Appl. No.: 10/690,112

(22) Filed: Oct. 21, 2003

(65) Prior Publication Data

US 2004/0136835 A1 Jul. 15, 2004

(30) Foreign Application Priority Data

Oct. 22, 2002 (DE) ..... 102 49 062

(51) Int. Cl.
*F04B 3/00* (2006.01)
*F04B 5/00* (2006.01)
*F04B 25/00* (2006.01)

(52) U.S. Cl. ..... 417/250; 417/62; 417/251; 417/254; 417/255; 417/440

(58) Field of Classification Search ..... 417/62, 417/250, 251, 254, 255, 440
See application file for complete search history.

(56) References Cited

U.S. PATENT DOCUMENTS 2,246,932 A * 6/1941 Collins ..... 417/62
4,043,704 A * 8/1977 Zimmern ..... 417/62
4,111,609 A * 9/1978 Braun ..... 417/243

FOREIGN PATENT DOCUMENTS

| | | |
|---|---|---|
| DE | 0202190 | 8/2002 |
| EP | 0715077 | 5/1996 |
| EP | 0863313 | 9/1998 |

OTHER PUBLICATIONS

Search Report.

* cited by examiner

*Primary Examiner*—Anthony D. Stashick
*Assistant Examiner*—Patrick Hamo
(74) *Attorney, Agent, or Firm*—Abelman, Frayne, Schwab

(57) ABSTRACT

A multi-stage reciprocating vacuum pump includes first (2) and second (4) pump chambers located in the pump housing (1) and in which respective pistons (6, 8) reciprocate, first and second conduits (14, 20) for communicating, respectively outlet and suction (15, 16) sides of the first pump chamber (2) with the suction side (17) of the second pump chamber (4), and shut-off elements (18, 21; 25) associated with the first and second conduits (14, 20) for selectively communicating the first and second conduits (14, 20) with the suction side (17) of the second pump chamber (4); and the method of operating the pump includes manipulating the shut-off elements so that the first and second conduits (14, 20) are selectively connected to the suction side (17) of the second pump chamber (4).

3 Claims, 2 Drawing Sheets

MULTI-STAGE RECIPROCATING VACUUM PUMP AND METHOD OF OPERATING THE SAME

BACKGROUND OF THE INVENTION

1. Field of the Invention

The present invention relates to a multi-stage reciprocating vacuum pump including a housing, at least one first pump chamber and at least one second pump chamber provided in the housing and each having a suction side and an outlet side, a piston reciprocating in each of the at least one first pump chamber and the at least one second pump chamber, a valve provided at the outlet side of each of the at least one first pump chamber and at least one second pump chamber, and a conduit for communicating the outlet side of the at least one first pump chamber with the suction side of the at least one second pump chamber, and to a method of operating the pump.

2. Description of the Prior Art

As a rule, reciprocating vacuum pumps for pumping out a recipient between the atmospheric pressure and a desired end vacuum of, e.g., $10^{-2}$ mbar are formed with several stages. One of such pumps is disclosed, e.g., in U.S. Pat. No. 5,921,755. In such a pump, separate stages are arranged in a row in order to be able to provide for the necessary pressure difference. The suction capacity is determined by a pump stage adjacent to the recipient. The following, normally with a reduced suction capacity, pump stages provide for further compression of the delivered gases up to the atmospheric pressure. By a proper gradation, the power consumption of a pump can be reduced.

In order to start the pumping-out process when the pressure in the recipient is still close to 1000 mbar, it is not necessary to further compress the gas which is aspirated with the first piston. The following pump stages are bypassed by using a pressure controlled by-pass valve, and these pump stages need not to perform any compression. However, at this initial stage, a higher suction capacity would be advantageous for accelerating the pumping process.

Accordingly, an object of the present invention is to provide a multi-stage reciprocating vacuum pump in which all stages in each phase of the pumping process can be used in such a way that the pump characteristics are improved and an effective pumping takes place.

Another object of the invention is the provide a compact and space-saving construction of a reciprocating vacuum pump, with the connecting conduits having minimum lengths and a reduced flow resistance.

A further object of the present invention is to provide a reciprocating vacuum pump in which the condensation of liquid and the amount of solids in the connecting conduits are eliminated or at least are reduced to a minimum.

SUMMARY OF THE INVENTION

These and other objects of the present invention, which will become apparent hereinafter, are achieved by providing in a reciprocating vacuum pump of type discussed above, a second conduit for communicating the suction side of the at least one first pump chamber with the suction side of the at least one second pump chamber, and means for selectively connecting the first conduit and the second conduit with the suction side of the at least one second pump chamber, with the first and second conduits and the selectively connecting means being located in the housing; and by providing a method of operating such a pump and including moving the selectively connecting means to its first position in which the second conduit is connected with the suction side of the at least one second pump chamber, and the first conduit is disconnected from the suction side of the at least one second pump chamber, so that gas, which enters through the suction side of the at least one first pump chamber, is pumped, in parallel, in the at least one first pump chamber and the at least one second pump chamber and is expelled through the respective valves provided at the outlet sides of the at least one first pump chamber and the at least one second pump chamber, respectively, and closing a discharge connection provided at the outlet side of the at least one first pump chamber and moving the selectively connecting means to its second position in which the second conduit is disconnected from the suction side of the at least one second pump chamber, and the first conduit is connected with the suction side of the at least one second pump chamber, so that gas entering through the suction side of the at least one first pump chamber is compressed in the at least one first pump chamber, flows therefrom through the first conduit into the at least one second pump chamber, is compressed in the second pump chamber and is expelled therefrom.

A reciprocating vacuum pump according to the present invention and the inventive method of operating such a pump permit to noticeably increase the suction capacity in the upper pressure region, with all available pistons aspirating the gas in parallel at the start of the pumping-out process. Only when the pressure in the recipient is of a magnitude at which the compression, which is produced by a piston, is not sufficient for compressing the aspirated gas to the atmospheric pressure, the parallel-operating pistons are switched to a series operation. In this way, all of the stages are optimally used, and an effective pumping out with minimal costs is achieved.

The integration of the connecting conduits and valves in the multi-stage pump permits to obtain a very compact construction. The length of the connecting conduits is reduced to a minimum which, in turn, reduces the flow resistance in the conduits to a minimum. Another big advantage of the inventive multi-stage pump consists in that the connecting conduits and other components, which are located in the pump housing, take its temperature. As this temperature is higher than the temperature outside of the housing, the condensate deposits are eliminated.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1:
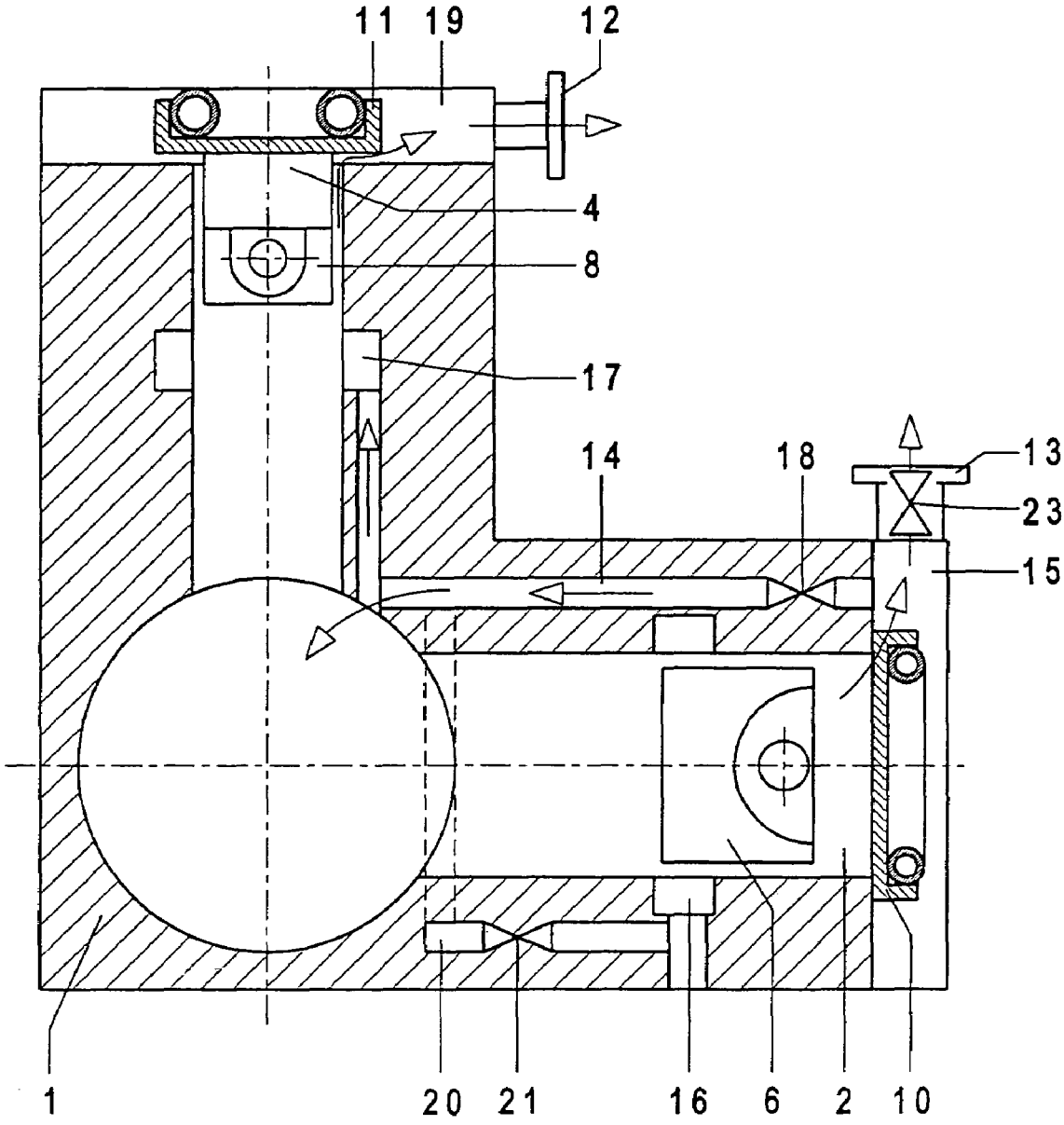
FIG. 1 a cross-sectional view of a two-stage reciprocating pump according to the present invention.

In a reciprocating two-stage pump according to the present invention, which is shown in the drawings, both stages are provided in a common housing 1. Each stage is formed of a pump chamber 2, 4 in which a piston 6, 8 reciprocates with values 10 and 11 provide for pumping of gases. The gas, which enters through the suction side 16 of the first pump chamber 2 and is compressed in the first pump chamber 2, is fed to the suction side 17 of the second pump chamber 4 through the gas outlet side 15 of the first pump chamber 2 and through a conduit 14 and, after further compression, in the second pump chamber 4, is expelled through the gas outlet 19 of the second pump chamber 4. The first and second pump chambers 2, 4 and the respective pistons 6, 8 have different sizes or gradation, i.e., the first pump chamber 2 is bigger than the second pump chamber 4. This is because with the gas being compressed in the first pump chamber 2, a smaller volume of the gas has to be compressed and pumped out in the second pump chamber 4.

According to the present invention, a shut-off element 18 is arranged in the connecting conduit 14. In addition, a further connecting conduit 20 is provided between the suction side 16 of the first pump chamber 2 and the suction side 17 of the second pump chamber 4. In the connecting conduit 20, a further shut-off element 21 is arranged. A discharge connection 13 is provided with its own shut-off element 23. All of the connecting conduits and respective shut-off elements are located at least partially in the pump housing 1.

A two-stage reciprocating pump according to the present invention can operate with the two stages connected in parallel or in series. The switching from one operational condition to another operational condition can take place in each of the operational phases.

At the start of the pumping process, it makes sense to use the complete suction capacity of all of the pump stages. To this end, in the embodiment shown in FIG. 1, the shut-off element 18 is closed, and the shut-off elements 21 and 23 are open. Thereby, the to-be-pumped gas can enter into the first pump chamber 2 through its suction side 16 and, after having been compressed with the piston 6, be expelled through the valve 10 and the gas outlet side 15 of the first pump chamber 2. Parallel thereto, the gas is fed to the suction side 17 of the second pump chamber 4 through the shut-off element 21 and the connecting conduit 20. After having been compressed with the second piston 8, the gas is pumped out of the second pump chamber 4 through the valve 11 and the gas outlet side 19.

Figure 2:
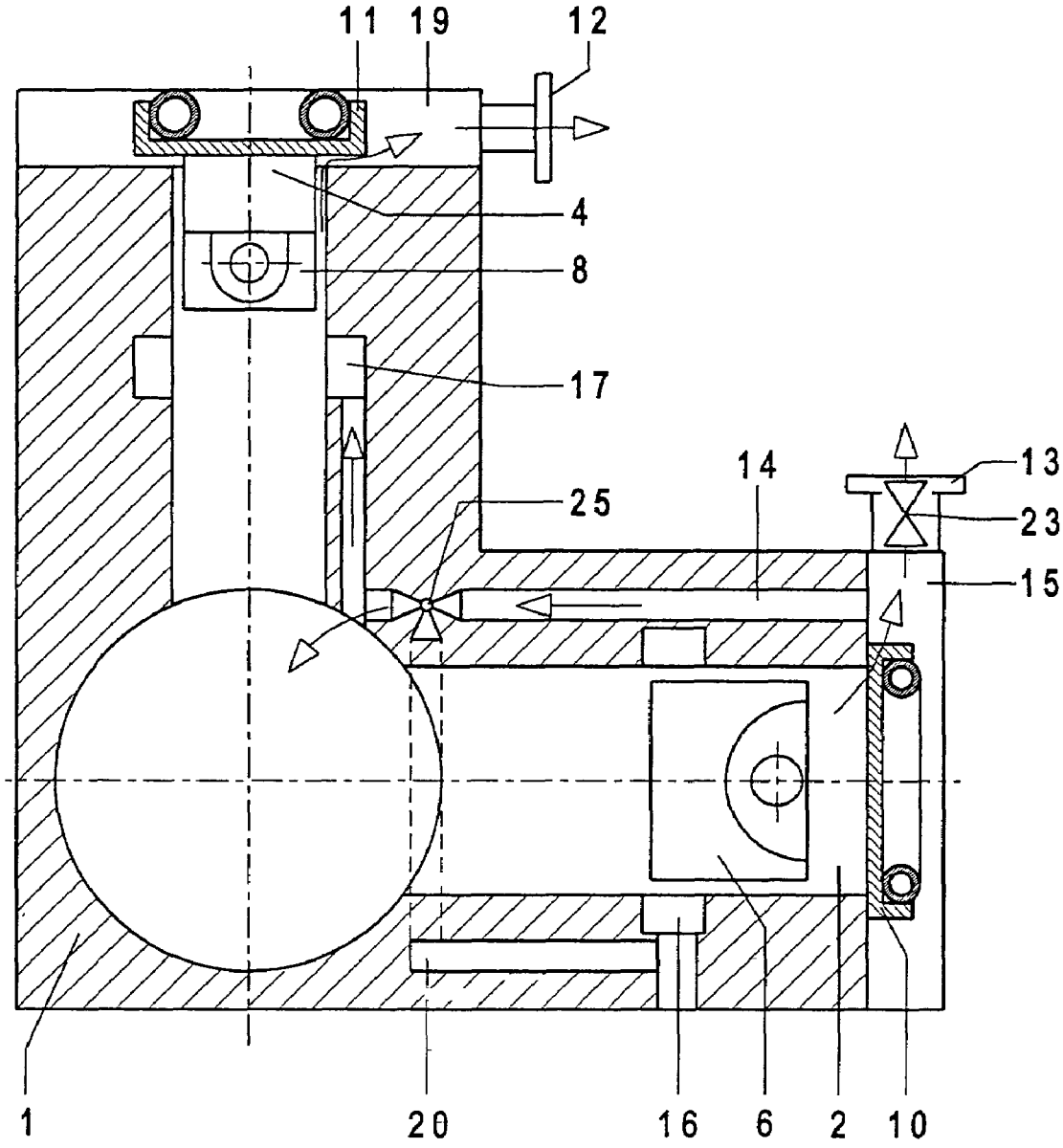
FIG. 2 a cross-sectional view of another embodiment of a reciprocating pump according to the present invention.

After a certain time of the parallel operation of the two stages, a condition is created at which the second pump stage can completely take over the gas compressed in the first pump chamber 2. When such a condition is created, switching to a series operation takes place. To this end, the shut-off element 21 is closed, together with the shut-off element 23. The gas, in this case, flows only through the shut-off element 18 and the connecting conduit 14 to the suction side 17 of the second pump chamber 4, is compressed further in the second pump chamber 4 and is expelled through the gas outlet side 19 of the second pump chamber 4. As it has already been mentioned above, switching from the parallel operation to the series operation and vice versa can take place during each phase of the pump operation. Instead of the shut-off elements 18 and 21, a three-way cock 25 can be provided at the intersection of the connecting conduits 14 and 20, as shown in FIG. 2.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A multi-stage reciprocating vacuum pump, comprising a housing (1); at least one first pump chamber (2) and at least one second pump chamber (4) provided in the housing (1) and each having a suction side (16, 17) and an outlet side (15, 19); a first piston (6) reciprocating in the at least one first pump chamber (2) and a second piston (8) reciprocating in the at least one second pump chamber (4); a valve (10, 11) provided at the outlet side (15, 19) of each of the at least one first pump chamber (2) and the at least one second pump chamber (4); a first conduit (14) for communicating the outlet side (15) of the at least one first pump chamber (2) with the suction side (17) of the at least one second pump chamber (4); a second conduit (20) for communicating the suction side (16) of the at least one first pump chamber (2) with the suction side (17) of the at least one second pump chamber (4); and means (18, 21; 25) for selectively connecting the first conduit (14) and the second conduit (20) with the suction side (17) of the at least one second pump chamber (4), the first and second conduits (14 and 20) and the selectively connecting means (18, 21; 25) being located in the housing (1), wherein selectively connecting means comprises a three-way cock (25) provided at an intersection of the first and second conduits (14 and 20) and having a first position in which gas entering through the suction side (16) of the at least one first pump chamber (2) is pumped, in parallel, in the at least one first pump chamber (2) and the at least one second pump chambers (4) and is expelled through the respective outer valves (10, 11) provided at the outlet sides (15, 19) of the at least one first pump chamber (2) and the at least one second pump chamber (4), and a second position in which gas entering through the suction side (16) of the at least one first pump chamber (2) is compressed in the at least one first pump chamber (2), with an entire compress gas volume flowing therefrom through the first conduit (14) into the at least one second pump chamber (4), is further compressed therein, and is expelled through the valve (11) provided at the outlet side (19) of the at least one second pump chamber (4).

2. A reciprocating vacuum pump as set forth in claim 1, further comprising a discharge connection (13), provided at an outlet side (15) of the at least one first pump chamber (2) and a shut-off element (23) provided at the discharge connection (13).

3. A method of operating a multi-stage reciprocating vacuum pump having a housing, at least one first pump chamber (2) and at least one second pump chamber (4) provided in the housing (1) and each having a suction side (16, 17) and an outlet side (15, 19), a piston (6, 8) reciprocating in each of the at least one first pump chamber (2) and the at least one second pump chamber (4), a valve (10, 11) provided at the outlet side (15, 19) of each of the at least one first pump chamber (2) and at least one second pump chamber (4), a first conduit (14) for communicating the outlet side (15) of the at least one first pump chamber (2) with the suction side (17) of the at least one second pump chamber (4); the method comprising the steps of providing a second conduit (20) for communicating the suction side (16) of the at least one first pump chamber (2) with the suction side (17) of the at least one second pump chamber (4), and means (18, 21; 25) for selectively connecting the first conduit (14) and the second conduit (20) with the suction side (17) of the at least one second pump chamber (40); moving the selectively connecting means to a first position thereof in which the second conduit (20) is connected with the suction side (17) of the at least one second pump chamber (4), and the first conduit (14) is disconnected form the suction side (17) of the at least one second pump chamber (4), whereby gas entering through the suction side (16) of the at least one first pump chamber (2) is pumped, in parallel, in the at least one first pump chamber (2) and the at least one second pump chambers (4) and is expelled through the respective valves (10, 11) provided at the outlet sides (15, 19) of the at least one first pump chamber (2) and the at least one second pump chamber (4), respectively; and closing a discharge connection (13) provided at the outlet side (15) of the at least one first pump chamber (2) and moving the selectively connecting means to a second position thereof in which the second conduit (20) is disconnected from the suction side (17) of the at least one second pump chamber (4), and the first conduit (14) is connected with the suction side (17) of the at least one second pump chamber (4), whereby gas entering through the suction side (16) of the at least one first pump chamber (2) is compressed in the at least one first pump chamber (2), flows therefrom through the first conduit (14) into the at least one second pump chamber (4), is further compressed therein, and is expelled through the valve (11) provided at the outlet side (19) of the at least one second pump chamber (4), wherein the selectively connecting means comprises a three-way cock, wherein the step of moving the selectively connecting means (25) to a first position thereof includes moving the cock to a first position thereof in which the second conduit is connected with the suction side (17) of the at least one second pump chamber (4), and the first conduit (14) is disconnected from the suction side (17) of the at least one second pump chamber (4), and wherein the step of closing the discharge connection (13) and moving the selectively connecting means to a position thereof includes closing the second shut-off element (21) and a third shut-off element (23) provided at the discharge connection (13), and moving the cock to a second position thereof in which the second conduit (20) is disconnected from the suction side (17) of the at least one second pump chamber (4), and the first conduit (14) is connected with the suction side (17) of the at least one second pump chamber (4), whereby gas entering through the suction side (16) of the at least one first pump chamber (2) is compressed in the at least one first pump chamber (2), flows therefrom through the first conduit (14) into the at least one second pump chamber (4), is further compressed therein, and is expelled through the valve (11) provided at the outlet side (19) of the at least one second pump chamber (4).

* * * * *